US006431065B1

(12) United States Patent
Demi et al.

(10) Patent No.: US 6,431,065 B1
(45) Date of Patent: Aug. 13, 2002

(54) SHEET-FEED PERFECTING PRESS

(75) Inventors: Jitsuo Demi; Hiroyuki Tamada; Yasunori Masuda, all of Mihara (JP)

(73) Assignee: Mitsubishi Heavy Industries, Ltd. (JP)

( * ) Notice: Subject to any disclaimer, the term of this patent is extended or adjusted under 35 U.S.C. 154(b) by 0 days.

(21) Appl. No.: 09/549,771

(22) Filed: Apr. 14, 2000

(30) Foreign Application Priority Data

Apr. 20, 1999 (JP) ..... 11-111733

(51) Int. Cl.[7] ..... B41F 5/02
(52) U.S. Cl. ..... 101/229; 101/183
(58) Field of Search ..... 101/181, 183, 101/229, 230

(56) References Cited

U.S. PATENT DOCUMENTS 5,555,804 A 9/1996 Kojima

FOREIGN PATENT DOCUMENTS

| | | |
|---|---|---|
| DE | 19635387 A | 3/1998 |
| EP | 0085751 | 8/1983 |
| EP | 0166128 A | 1/1986 |
| EP | 0906826 A | 4/1999 |
| JP | 6-336003 | 12/1994 |
| JP | 07009654 A | 1/1995 |
| JP | 11028800 A | 2/1999 |
| JP | 11099619 A | 4/1999 |

OTHER PUBLICATIONS

European Search Report, European Application No. 00300648.3–2304–, Date of Mailing: Jul. 3, 2000.

*Primary Examiner*—Ren Yan
(74) *Attorney, Agent, or Firm*—Myers Bigel Sibley & Sajovec, P.A.

(57) ABSTRACT

The present invention reduces stains, prevents the degradation in print quality, reduces the work for removing stains, and decreases the machine size. To achieve the present invention, the sheet-feed perfecting press has top surface printing devices and back surface printing devices which each has an ink arrangement, a plate cylinder, a rubber blanket cylinder, and an impression cylinder and are arranged alternately. Also, the printing press is provided with two intermediate cylinders between adjacent printing pressure points of a plurality of printing pressure points at which a pressure is applied to a sheet at the time of printing. The diameter of the impression cylinder is made larger than the diameter of the plate cylinder, and the intermediate cylinders are arranged in a zigzag form with respect to the horizontal line. Thereby, a grip change position at which grip change of sheet to the intermediate cylinder is made is kept away from the printing pressure point.

6 Claims, 7 Drawing Sheets

SHEET-FEED PERFECTING PRESS

BACKGROUND OF THE INVENTION AND RELATED ART STATEMENT

1. Field of the Invention

The present invention relates to a sheet-feed perfecting press for printing both sides of a sheet.

2. Description of Related Art

FIG. 6 is a schematic view of a conventional printing press of this type. This printing press has a sheet feed unit 1, a printing unit 2, and a sheet discharge unit 3 (taking-off apparatus). In the printing unit 2, top surface printing devices (outer printing devices) 2*a* and 2*c* and back surface printing devices (inner printing devices) 2*b* and 2*d,* each having an ink arrangement K, a dampening arrangement D, a plate cylinder P, a rubber blanket cylinder B, and an impression cylinder I, are arranged alternately. A delivery cylinder T1 is disposed close to the top surface printing device 2*a,* and two intermediate cylinders T are disposed between the impression cylinder I for the back surface printing device 2*b* and the impression cylinder I for the top surface printing device 2*c.* Between the impression cylinder I for the back surface printing device 2*d* and the sheet discharge unit 3, three intermediate cylinders T are disposed. The impression cylinders I and the intermediate cylinders T have the same diameter, and are arranged on substantially the same horizontal plane.

In this printing press, a sheet 4 is supplied one after another by the sheet feed unit 1, and after an outer side 7 thereof being printed by the top surface printing devices 2*a* and 2*c,* and an inner side 8 thereof being printed by the back surface printing devices 2*b* and 2*d,* the printed sheet 4 is stacked by the sheet discharge unit 3. When the outer side 7 or the inner side 8 is printed by the printing unit 2, the outer side 7 is printed by the top surface printing device 2*a,* for example. Next, when the inner side 8 is printed by the back surface printing device 2*b,* the outer side 7, which has been printed by the top surface printing device 2*a,* is in contact with the impression cylinder I at a printing pressure point 5 where a pressure is applied to the sheet surface by the back surface printing device 2*b.* The length between the printing pressure point 5 for the top surface printing to the printing pressure point 5 for the back surface printing is shorter than or approximately equal to the length of the sheet 4.

FIG. 7 is a schematic view of another conventional printing press. In this figure, the same reference characters are applied to elements which are essentially the same as those shown in FIG. 6, and the duplicate explanation of these elements is omitted. For the printing press shown in FIG. 7, the impression cylinders I for the printing devices 2*a,* 2*b,* 2*c* and 2*d* each have a diameter larger than that of the plate cylinders P and the rubber blanket cylinders B, and are arranged somewhat in a zigzag form vertically. This printing press is different from the printing press shown in FIG. 6 in that only one intermediate cylinder T is disposed between the back surface printing device 2*d* and the sheet discharge unit 3. The distance between the printing pressure point 5 on the impression cylinder I for the top surface printing device 2*a* and the printing pressure point 5 for the back surface printing device 2*b* is approximately equal to or slightly longer than the length of the sheet 4.

OBJECT AND SUMMARY OF THE INVENTION

In the above-described conventional printing presses, the outer side 7, which has been printed by the top surface printing device 2*a,* is in contact with the impression cylinder I at the printing pressure point 5 for the back surface printing device 2*b.* Therefore, the surface of the impression cylinder I is stained with ink, so that this stain stains the outer side 7 of the next sheet 4, resulting in a decrease in print quality. This poses a problem in that it is necessary to strictly take measures for preventing stains and to frequently perform work for removing stains. Also, the printing press shown in FIG. 6 requires a large size because the impression cylinders I and the intermediate cylinders T are arranged on the same plane.

The present invention has been made in view of the above situation, and accordingly an object thereof is to provide a sheet-feed perfecting press in which the above-described stains can be reduced, the degradation in print quality can be minimized, work for removing stains can reduced, and the machine size can be decreased.

To achieve the above object, the present invention provides a sheet-feed perfecting press which has a top surface printing device and a back surface printing device each having a plate cylinder and an impression cylinder and is provided with a plurality of printing pressure points at which a pressure is applied to the surface of a sheet at the time of printing, characterized in that an intermediate cylinder is provided between the adjacent printing pressure points of the plurality of printing pressure points.

Also, in the present invention, the diameter of the impression cylinder is preferably made larger than the diameter of the plate cylinder. The diameter of the intermediate cylinder is preferably made larger than the plate cylinder. Also, the diameter of a rubber blanket cylinder for applying a pressure to the surface of the sheet at the time of printing may be larger than the diameter of the plate cylinder.

Further, in the present invention, at least two intermediate cylinders are arranged between the plate cylinder and the impression cylinder, and the intermediate cylinders can be arranged in a zigzag form with respect to the horizontal line. Also, it is preferable that a grip change position where grip change of sheet to the intermediate cylinder is made be kept away from the printing pressure point.

DETAILED DESCRIPTION OF PREFERRED EMBODIMENTS

Embodiments of a sheet-feed perfecting press will be described in detail with reference to FIGS. 1 to 5.

[Embodiment 1]

Figure 1:
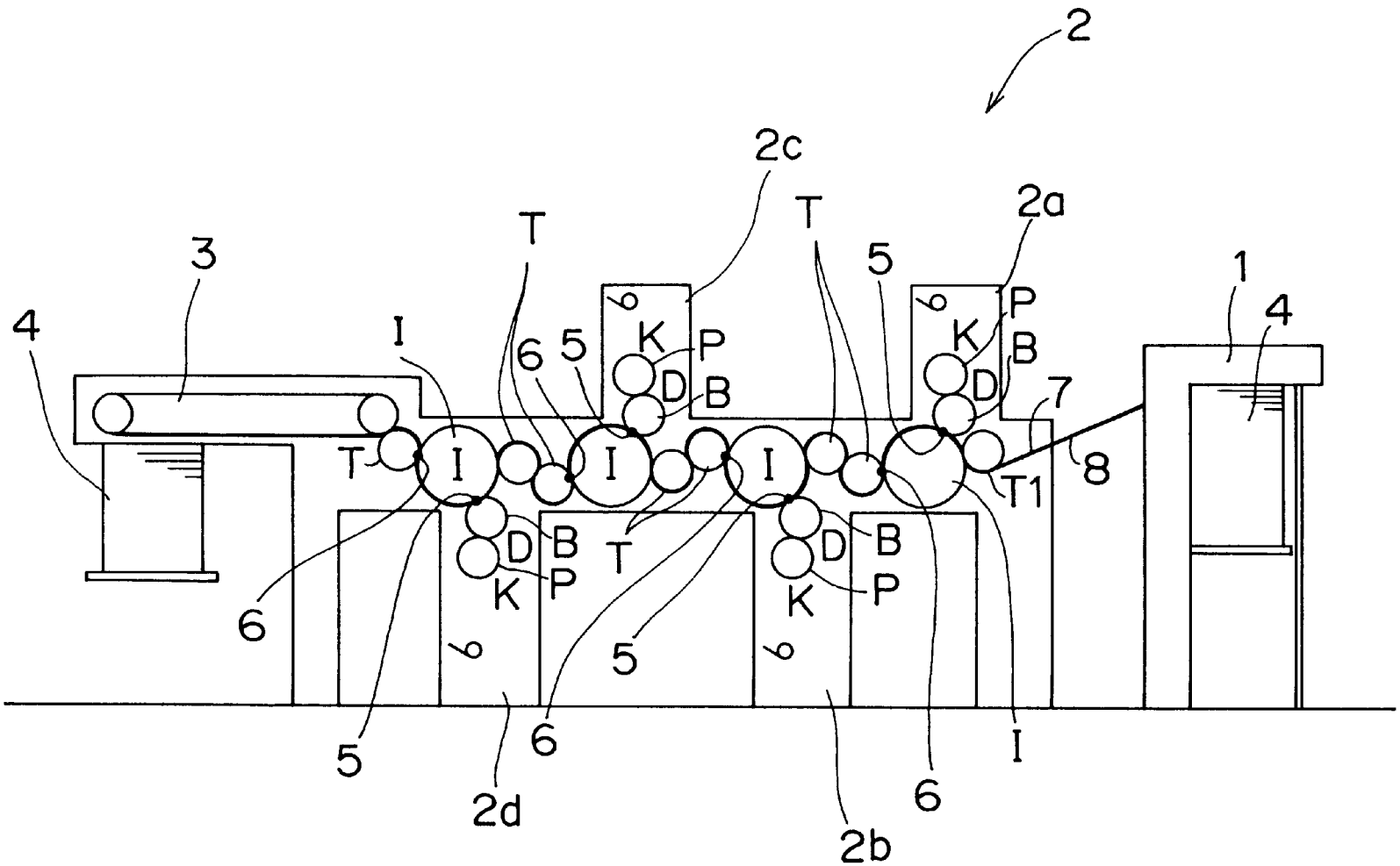
FIG. 1 is a schematic view of a sheet-feed perfecting press in accordance with a first embodiment of the present invention.

FIG. 1 is a schematic view of a sheet-feed perfecting press in accordance with a first embodiment of the present invention. In this figure, the same reference characters are applied to elements which are essentially the same as those in the conventional press, and the duplicate explanation of these elements is omitted.

This printing press is provided with two intermediate cylinders T, T with the same diameter between an impression cylinder I for a top surface printing device 2*a* and an impression cylinder I for a back surface printing device 2*b,* between the impression cylinder I for the back surface printing device 2*b* and an impression cylinder I for a top surface printing device 2*c,* and between the impression cylinder I for the top surface printing device 2*c* and an impression cylinder I for a back surface printing device 2*d,* respectively.

In this embodiment, the cylinder diameter of the impression cylinder I is twice the cylinder diameter of a plate cylinder, and the centers of four impression cylinders I are arranged on substantially the same horizontal plane. The circumferential dimension of the impression cylinder I from a printing pressure point 5 on the impression cylinder I, at which a pressure is applied to the surface of a sheet 4 by a rubber blanket cylinder B at the time of printing, to a grip change position 6, at which the sheet 4 is delivered to the intermediate cylinder T is designed to be larger than the maximum printing dimension of the sheet 4. FIG. 1 shows the intermediate cylinder T having the same diameter as that of the plate cylinder P.

The expressions of twice the cylinder diameter the same diameter as that of the cylinder, etc. show approximate values, and values in the practical range of the printing industry. This is true for the following descriptions.

The impression cylinder I, the rubber blanket cylinder B, the plate cylinder P, an ink arrangement K, and the like are generally arranged as shown in FIG. 1 considering the work efficiency. Specifically, the plate cylinder P is disposed on the side of the ink arrangement K apart from the impression cylinder I, and the rubber blanket cylinder B is arranged between the plate cylinder P and the impression cylinder I, by which the rubber blanket cylinder B applies a pressure to the surface of the sheet 4 toward the impression cylinder I. In this state, in order that the dimension from the printing pressure point 5 to the grip change position 6 is made as large as possible, the grip change position 6, which is a contact point with the next intermediate cylinder T of the impression cylinder I, is made to lie at a position distant from the printing pressure point 5. In other words, it makes a long distance, which is a run along the cylindrical periphery of the impression cylinder I, between the printing pressure point 5 and the grip change position 6 by arranging the position of the grip change position 6 at a lower position than the horizontal level (center level) of the impression cylinder I. The adjacent intermediate cylinders T are arranged in a zigzag form with the horizontal line being a boundary.

The sheet 4 supplied from the sheet feed unit 1 passes through the lower side of the cylindrical periphery of a delivery cylinder T1, the upper side of the cylindrical periphery of the impression cylinder I for the top surface printing device 2*a,* the lower side of the cylindrical periphery of the first intermediate cylinder I, and so on, that is, passes through the lower side and the upper side alternately, and is sent to a sheet discharge unit 3. The sheet 4 is conveyed on each cylinder by a claw (not shown). A print picture is transferred from the rubber blanket cylinder B to the sheet 4 at the printing pressure point 5 while the sheet 4 is conveyed on the impression cylinder I. The grip change position 6 is a position where grip change is made when the sheet 4 is delivered at the contact point between the impression cylinder I and the intermediate cylinder T.

By the configuration of the above-described Embodiment 1 of the present invention, when the next inner side or outer side printing is performed after the top surface printing or the back surface printing, the dimension from the printing pressure point 5 for the top surface printing device 2*a* to the printing pressure point 5 for the impression cylinder I for the next back surface printing device 2*b* can be made larger. That is to say, by making the elapsed time from the preceding printing pressure point 5 to the next printing pressure point 5 long, the degree of drying of the printed sheet 4 is improved, so that the degree of stain of the impression cylinder I, that is, the degree of stain of the preceding printing surface is reduced.

Figure 2:
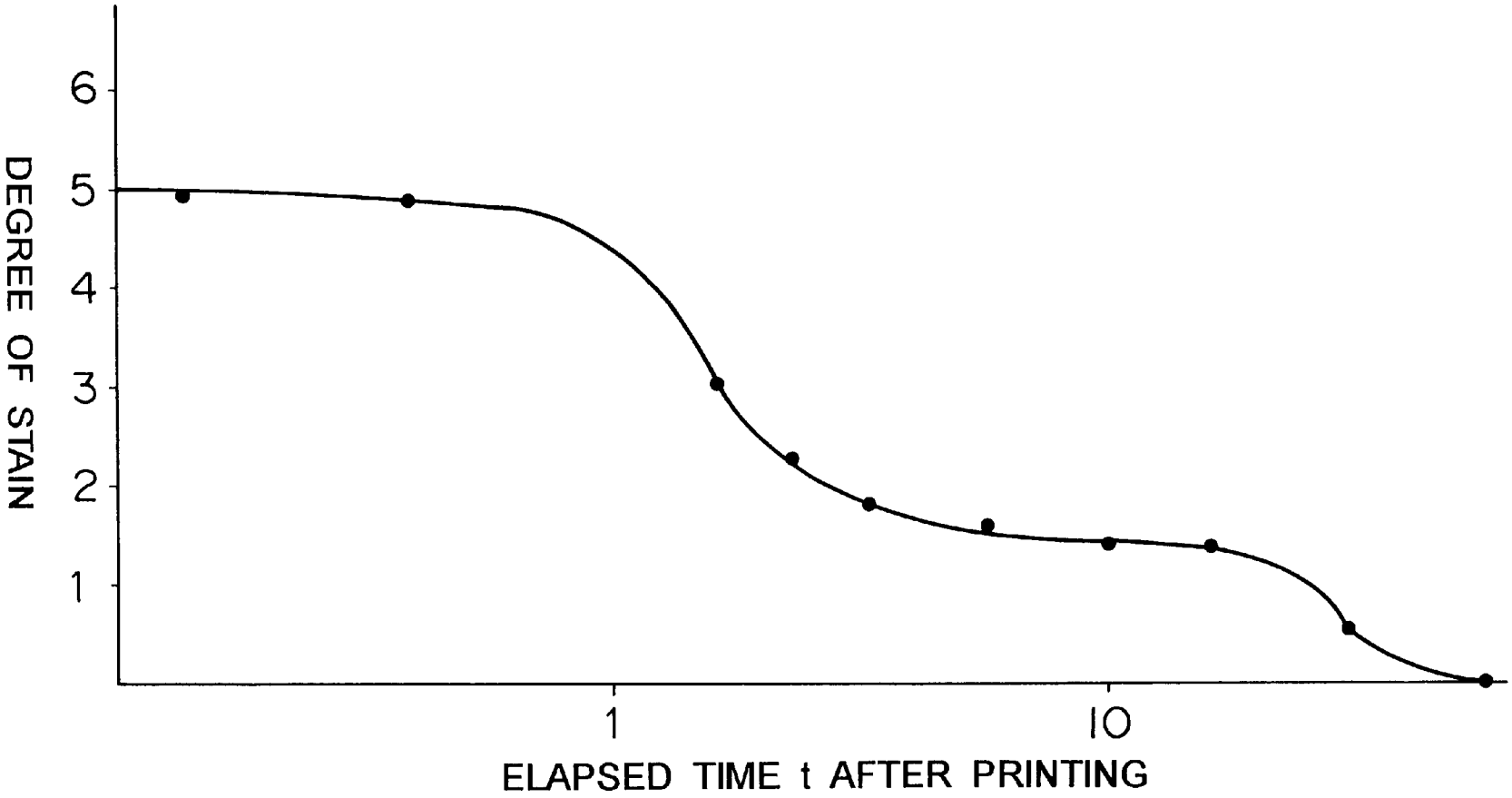
FIG. 2 is a graph showing a change in the degree of stain on a printing surface with respect to the elapsed time after printing for the sheet-feed perfecting press in accordance with the first embodiment of the present invention.

FIG. 2 is a graph showing a change in the degree of stain on a printing surface with respect to the elapsed time t after printing for the sheet-feed perfecting press in accordance with the first embodiment of the present invention. As shown in FIG. 2, the degree of stain changes depending on the elapsed time t after printing. In Embodiment 1 shown in FIG. 1, about two times of drying time can be provided as compared with the conventional press. Thereby, the stains are reduced, so that the print quality can be improved. Also, the measures for preventing stains can be reduced, and the work for removing stains can be decreased.

In addition, since the dimension from the printing pressure point 5 to the grip change position 6 on the intermediate cylinder T is made larger than the maximum printing size, the occurrence of a trouble such that the shock of grip change affects the picture at the time of printing, resulting in the appearance of stripe, can be prevented. Also, since the intermediate cylinders T are arranged in a zigzag form with respect to the horizontal line, the length of the whole machine can be shortened.

[Embodiment 2]

Figure 3:
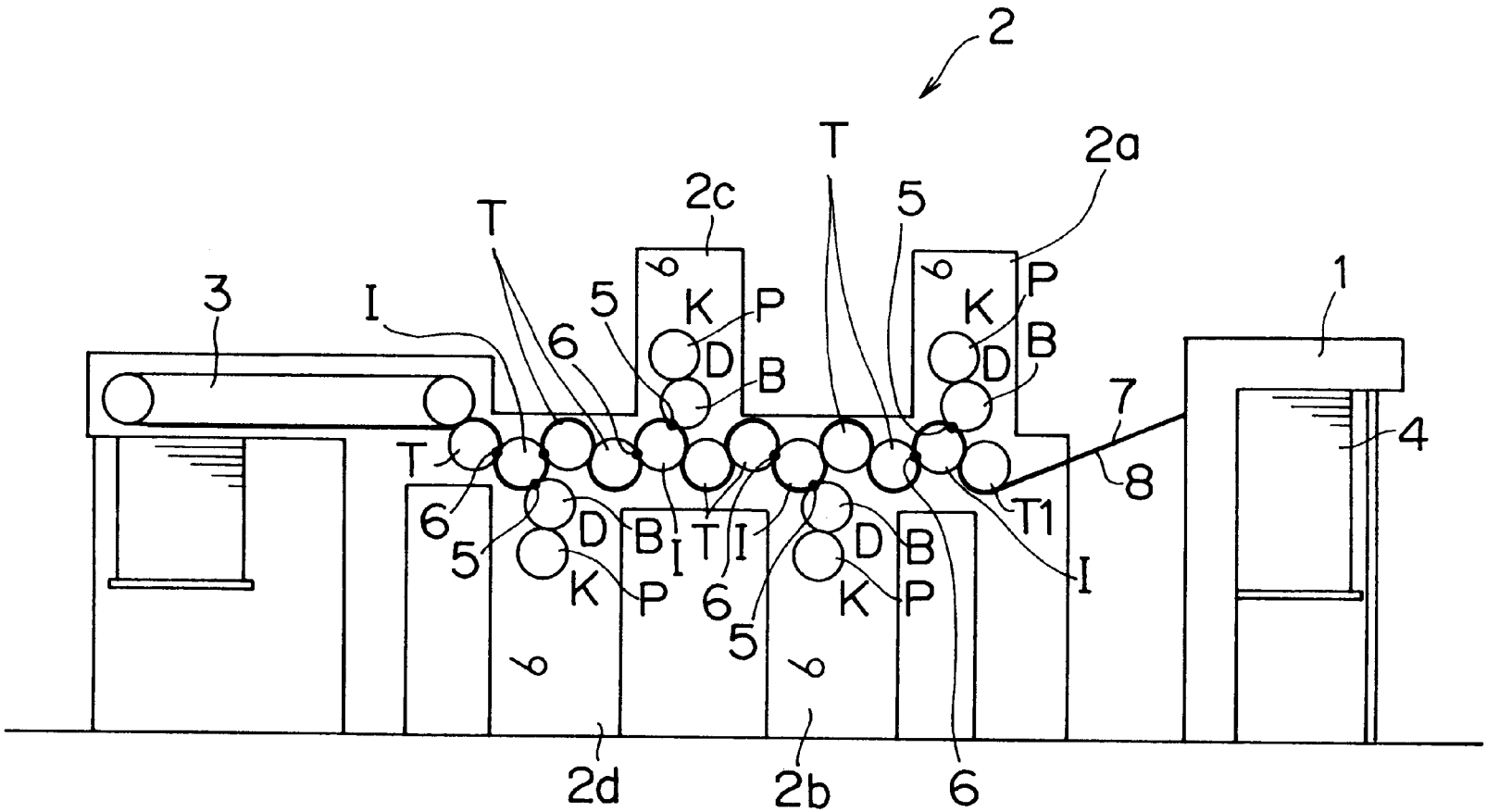
FIG. 3 is a schematic view of a sheet-feed perfecting press in accordance with a second embodiment of the present invention.

FIG. 3 is a schematic view of a sheet-feed perfecting press in accordance with a second embodiment of the present invention. In this figure, the same reference characters are applied to elements which are essentially the same as those already described, and the duplicate explanation of these elements is omitted. Embodiment 2 and the following embodiments are explained concretely and clearly in the same way as Embodiment 1, focusing on the configuration, operation, and effects different from the preceding embodiments.

Although the diameter of the impression cylinder is twice that of the plate cylinder P in the above-described Embodiment 1, in the sheet-feed perfecting press in accordance with Embodiment 2, the impression cylinder I and the plate cylinder P have the same diameter, and the adjacent cylinders are arranged in a zigzag form in succession. To make the grip change position 6 distant from the printing pressure point 5 to the utmost, the grip change position 6 is shifted to the side distant from the printing pressure point 5 from the horizontal position of the impression cylinder I, by which the distance between the printing pressure point 5 and the printing pressure point 5 for the next printing device is made long. That is to say, the next intermediate cylinder T of the impression cylinder I is disposed at a position shifted to the side distant from the printing pressure point 5 of the impression cylinder I. In other words, it makes a long distance, which is a run along the cylindrical periphery of the impression cylinder I, between the printing pressure point 5 and the grip change position 6 by arranging the center of the intermediate cylinder T at a lower position than the center of the impression cylinder I.

For the printing press in accordance with Embodiment 2, although the distance between the printing pressure point 5 to the next printing pressure point 5 is shorter than that of Embodiment 1, the distance is about two times or less the length of the sheet 4 as compared with the conventional press, so that an effect of preventing stains can be achieved, and also this printing press has an effect of decreasing the machine size.

[Embodiment 3]

Figure 4:
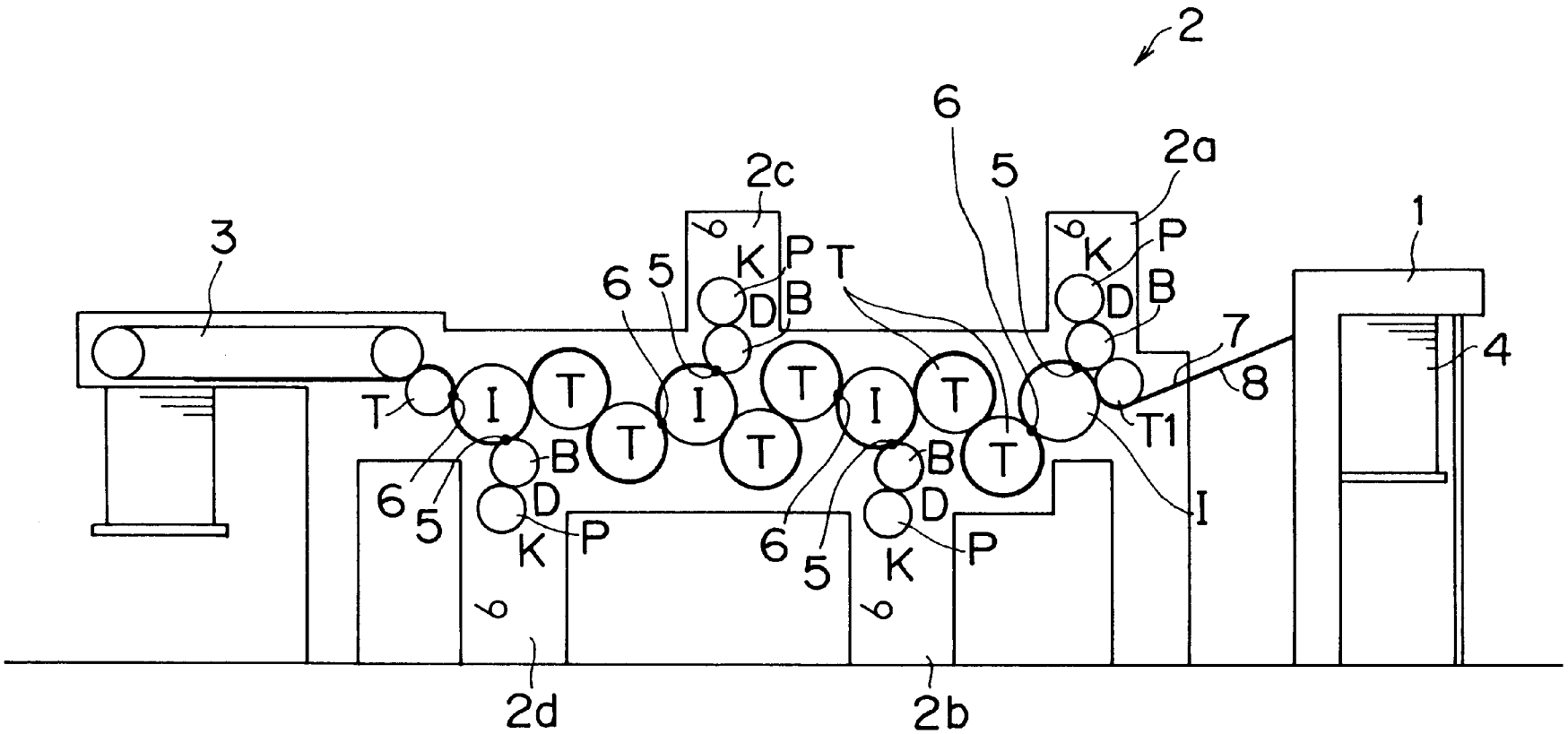
FIG. 4 is a schematic view of a sheet-feed perfecting press in accordance with a third embodiment of the present invention.

FIG. 4 is a schematic view of a sheet-feed perfecting press in accordance with a third embodiment of the present invention. Although the intermediate cylinder T and the plate cylinder P have the same diameter in the configuration of Embodiment 1, the diameter of the intermediate cylinder T in this embodiment is twice the diameter of the plate cylinder P, being the same as the diameter of the impression cylinder I. The center of one of the two intermediate cylinders T, T disposed between the impression cylinders I, I greatly shifts downward from the center of the impression cylinder I, and lies at a position lower than the lowermost surface of the impression cylinder I, so that the grip change position 6 lies at a position close to the lowermost surface of the impression cylinder I.

Embodiment 3 achieves the same operation and effects as those of Embodiment 1, and additionally has an effect of reducing stains because much drying time can be spent.

[Embodiment 4]

Figure 5:
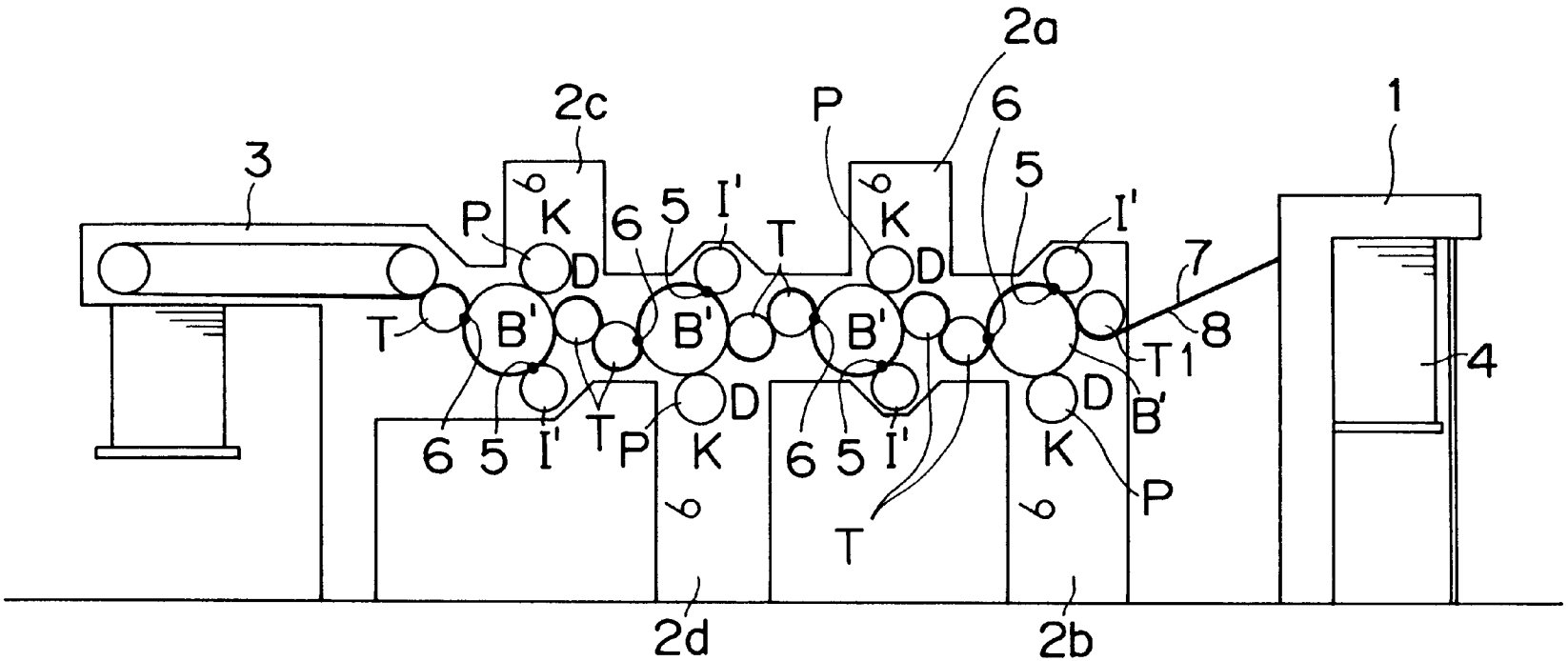
FIG. 5 is a schematic view of a sheet-feed perfecting press in accordance with a fourth embodiment of the present invention.
Figure 6:
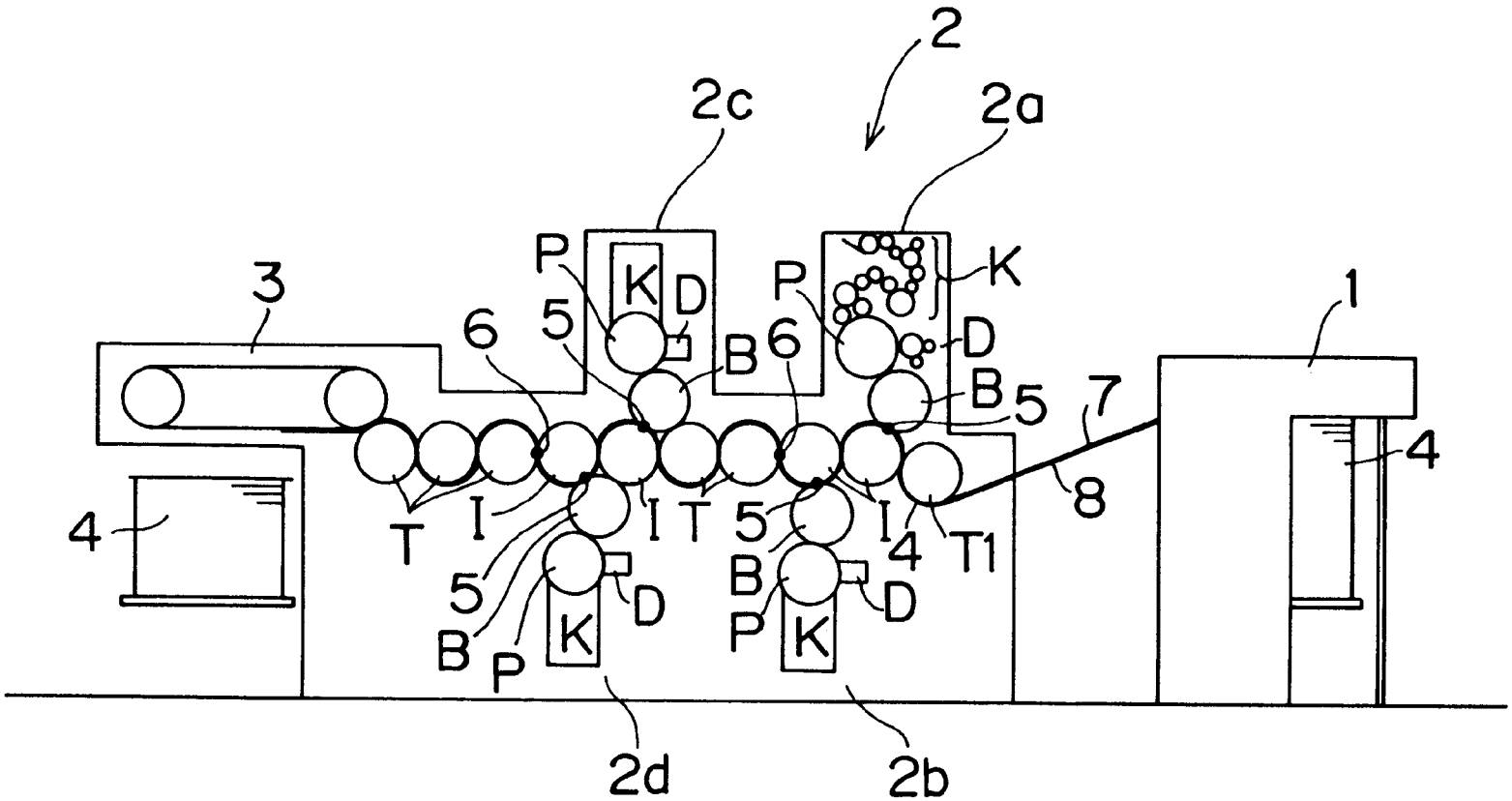
FIG. 6 (RELATED ART)
FIG. 6 is a schematic view of a conventional sheet-feed perfecting press.
Figure 7:
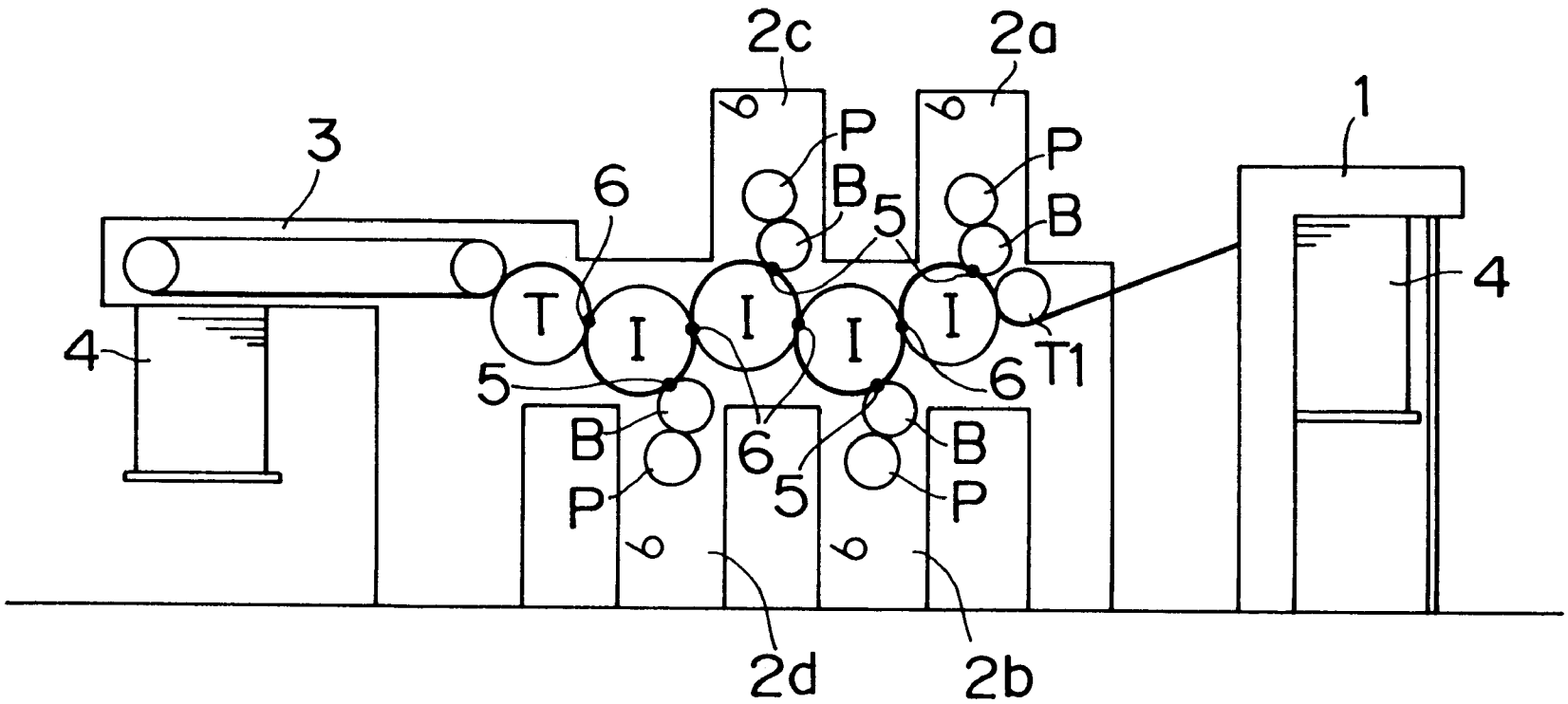
FIG. 7 (RELATED ART)
FIG. 7 is a schematic view of another conventional sheet-feed perfecting press.

FIG. 5 is a schematic view of a sheet-feed perfecting press in accordance with a fourth embodiment of the present invention. Although the sheet 4 is conveyed by the impression cylinder I in the configuration of Embodiment 1, the sheet 4 is conveyed by rubber blanket cylinders B' disposed on substantially the same plane in Embodiment 4. In the printing press in accordance with Embodiment 4, the rubber blanket cylinder B' has a diameter two times or more as large as the diameter of the plate cylinder P, and it is provided with a claw for conveying the sheet 4. Even numbers, that is, two of intermediate cylinders T, T are provided between the rubber blanket cylinders B', by which the peripheral length between the printing pressure point 5 on the rubber cylinder B' and the grip change position 6 for changing the grip of the sheet 4 is made longer than the print length of the sheet 4.

In Embodiment 4, the sheet 4 passes through the lower side of the cylindrical periphery of the delivery cylinder T1, the upper side of the cylindrical periphery of the rubber blanket cylinder B' of the top surface printing device 2*a*, the lower side of the cylindrical periphery of the first intermediate cylinder T, and so on, that is, passes through the lower side and the upper side alternately, and is sent to the sheet discharge unit 3. The sheet 4 is taken from the delivery cylinder T1, printed at the printing pressure point 5, delivered to the intermediate cylinder T at the grip change position 6, and conveyed to the sheet discharge unit 3 in the same way in succession. In this case, an impression cylinder I' is a simple cylinder, and can have a free diameter.

Embodiment 4 achieves the same operation and effects as those of Embodiment 1, and additionally has an effect of decreasing the size of the printing press because the diameter of the impression cylinder I' can be selected freely.

The present invention is not limited to the above-described embodiments, and various modifications and changes can be made. For example, even numbers of four or more intermediate cylinders can be provided between the printing pressure points 5, 5. Also, the diameter of the impression cylinder I in Embodiment 1 can be less than two times or over two times as large as the diameter of the intermediate cylinder T. The diameters of the impression cylinder I and the intermediate cylinder T in Embodiment 3 can be set so as to be less than two times or over two times as large as the diameter of the plate cylinder P. Also, the diameter of the rubber blanket cylinder B' in Embodiment 4 can be less than two times or over two times as large as the diameter of the plate cylinder P.

The present invention achieves the following effects.

In the present invention, the intermediate cylinders are provided between the adjacent printing pressure points of the plurality of printing pressure points, by which the elapsed time between the adjacent printing pressure points is lengthened. Therefore, a long drying time can be secured at the time when the sheet is printed, so that the print quality can be improved and the work for removing stains can be reduced.

Also, in the present invention, the diameter of the impression cylinder is made larger than the diameter of the plate cylinder, the diameter of the intermediate cylinder is made larger than the diameter of the plate cylinder, or the diameter of the rubber blanket cylinder is made larger than the diameter of the plate cylinder. By this configuration, the distance between the adjacent printing pressure points can further be increased, so that the sheet drying time can be lengthened, and the improvement in print quality and the reduction in stain removing work can be achieved more surely.

Further, at least two intermediate cylinders are arranged between the plate cylinder and the impression cylinder, and the intermediate cylinders are arranged in a zigzag form with respect to the horizontal line, by which the overall dimensions of the machine can be decreased. Also, by keeping the grip change position, where grip change of sheet to the intermediate cylinder is made, away from the printing pressure point, the distance between the printing pressure point to the next printing pressure point can be made large, by which the stains on the sheet can be reduced, the degradation in quality can be prevented, and the work for removing stains on the printing press can be reduced.

What is claimed is:

1. A sheet-feed perfecting press comprising:

a first top surface printing device that comprises a first plate cylinder, a first rubber blanket cylinder, a first impression cylinder, and a first printing pressure point at which a pressure is applied to the surface of a sheet at the time of printing the top surface of the sheet;

a bottom surface printing device that comprises a second plate cylinder, a second rubber blanket cylinder, a second impression cylinder, and a second printing pressure point at which a pressure is applied to the surface of a sheet at the time of printing the bottom surface of the sheet;

an even number of intermediate cylinders arranged between the first printing pressure point and the second printing pressure point;

a second top surface printing device that comprises a third plate cylinder, a third rubber blanket cylinder, a third impression cylinder, and a third printing pressure point at which a pressure is applied to the surface of a sheet at the time of printing the top surface of the sheet; and an even number of intermediate cylinders arranged between the second printing pressure point and the third printing pressure point.

2. The sheet-feed perfecting press according to claim 1, wherein the diameter of at least one of said first, second, and third impression cylinders is larger than the diameter of at least one of said first, second, and third plate cylinders.

3. The sheet-feed perfecting press according to claim 1, wherein the diameter of at least one of said first, second, and third intermediate cylinders is larger than the diameter of at least one of said first, second, and third plate cylinders.

4. The sheet-perfecting press according to claim 1, wherein said first, second, and third rubber blanket cylinders are configured to apply a pressure to the surface of the sheet at the time of printing, and the diameter of at least one of said first, second, and third rubber blanket cylinders is larger than the diameter of at least one of said first, second, and third plate cylinders.

5. The sheet-perfecting press according to claim 1, wherein an end of the axis of the first impression cylinder, an end of the axis of the second impression cylinder, and an end of the axis of the third impression cylinder are three points on a first horizontal line, wherein the two intermediate cylinders arranged between the first printing pressure point and the second printing pressure point are arranged between the first impression cylinder and the second impression cylinder, wherein the two intermediate cylinders arranged between the second printing pressure point and the third printing pressure point are arranged between the second impression cylinder and the first impression cylinder, and wherein the two intermediate cylinders arranged between the first printing pressure point and the second printing pressure point are in a zigzag arrangement with respect to the first horizontal line, and the two intermediate cylinders arranged between the second printing pressure point and the third printing pressure point are in a zigzag arrangement with respect to the first horizontal line; or wherein an end of the axis of the first rubber blanket cylinder, an end of the axis of the second rubber blanket cylinder, and an end of the axis of the third rubber blanket cylinder are three points on a second horizontal line, wherein the two intermediate cylinders arranged between the first printing pressure point and the second printing pressure point are arranged between the first rubber blanket cylinder and the second rubber blanket cylinder, wherein the two intermediate cylinders arranged between the second printing pressure point and the third printing pressure point are arranged between the second rubber blanket cylinder and the third rubber blanket cylinder, and wherein the two intermediate cylinders arranged between the first printing pressure point and the second printing pressure point are in a zigzag arrangement with respect to the second horizontal line, and the two intermediate cylinders arranged between the second printing pressure point and the third printing pressure point are in a zigzag arrangement with respect to the second horizontal line.

6. The sheet-feed perfecting press according to claim 1, wherein a circumferential distance between a grip change position and the first printing pressure point is longer than a print length of the sheet, the grip change position being a position at which the grip of the sheet by the sheet-feed perfecting press changes from the first rubber blanket cylinder or the first impression cylinder to one of the two intermediate cylinders arranged between the first printing pressure point and the second printing pressure point.

* * * * *

UNITED STATES PATENT AND TRADEMARK OFFICE

CERTIFICATE OF CORRECTION

PATENT NO. : 6,431,065 B1
DATED : August 13, 2002
INVENTOR(S) : Demi et al.

It is certified that error appears in the above-identified patent and that said Letters Patent is hereby corrected as shown below:

Column 7,
Line 25, should read as follows:

-- impression cylinder and the third impression cylinder, and --

Signed and Sealed this

Twenty-seventh Day of May, 2003

JAMES E. ROGAN
*Director of the United States Patent and Trademark Office*